US005930996A

United States Patent [19]

Nakamura et al.

[11] Patent Number: 5,930,996

[45] Date of Patent: Aug. 3, 1999

[54] AUTO-ACCELERATION SYSTEM FOR PRIME MOVER OF HYDRAULIC CONSTRUCTION MACHINE AND CONTROL SYSTEM FOR PRIME MOVER AND HYDRAULIC PUMP

[75] Inventors: Kazunori Nakamura, Ibaraki-ken; Ei Takahashi, Tsuchiura; Tsukasa Toyooka, Ibaraki-ken; Kouji Ishikawa, Ibaraki-ken; Tsuyoshi Nakamura, Ibaraki-ken; Yoichi Kowatari, Ibaraki-ken; Tadatoshi Shimamura, Ishioka; Genroku Sugiyama, Ibaraki-ken; Toichi Hirata, Ushiku, all of Japan

[73] Assignee: Hitachi Construction Machinery Co., Ltd., Tokyo, Japan

[21] Appl. No.: 09/164,365

[22] Filed: Oct. 1, 1998

[30] Foreign Application Priority Data

Oct. 2, 1997 [JP] Japan ..... 9-269973

[51] Int. Cl.[6] ..... F16D 31/02

[52] U.S. Cl. ..... 60/426; 60/431

[58] Field of Search ..... 60/420, 426, 431; 417/34

[56] References Cited

U.S. PATENT DOCUMENTS 4,967,557 11/1990 Izumi et al. ..... 60/431 X
5,295,353 3/1994 Ikari ..... 60/431
5,303,551 4/1994 Lee ..... 60/431
5,406,793 4/1995 Maruyama et al. ..... 60/431

FOREIGN PATENT DOCUMENTS 7-119506 5/1995 Japan .

*Primary Examiner*—Hoang Nguyen
*Attorney, Agent, or Firm*—Fay, Sharpe, Beall, Fagan, Minnich & McKee

[57] ABSTRACT

In the arm-crowding or track operation, a calculating portion (700*d*2 or 700*d*4) calculates a modification gain (KAC or KTR) depending on an operation pilot pressure and a calculating portion (700*g*) calculates a decrease modification (DND) based on the KAC or KTR, while a calculating portion (700*m* or 700*p*) calculates a modification gain (KACH or KTRH) depending on an operation pilot pressure and calculating portions (700*q*–700*s*) calculate an increase modification (DNH) based on the KACH or KTRH. A reference target engine revolution speed NR0 is modified using the DND and DNH. In other operations than the arm-crowding and track operations, NR0 is modified using only the decrease modification (DND) calculated from the modification gain just depending on the operation pilot pressure. In the operation where an engine revolution speed is desired to become higher as an actuator load increases, the engine revolution speed can be controlled in accordance with change of the actuator load as well. In other operations, the engine revolution speed can be controlled just depending on the direction and input amount in and by which corresponding operation instructing apparatus is operated.

5 Claims, 7 Drawing Sheets

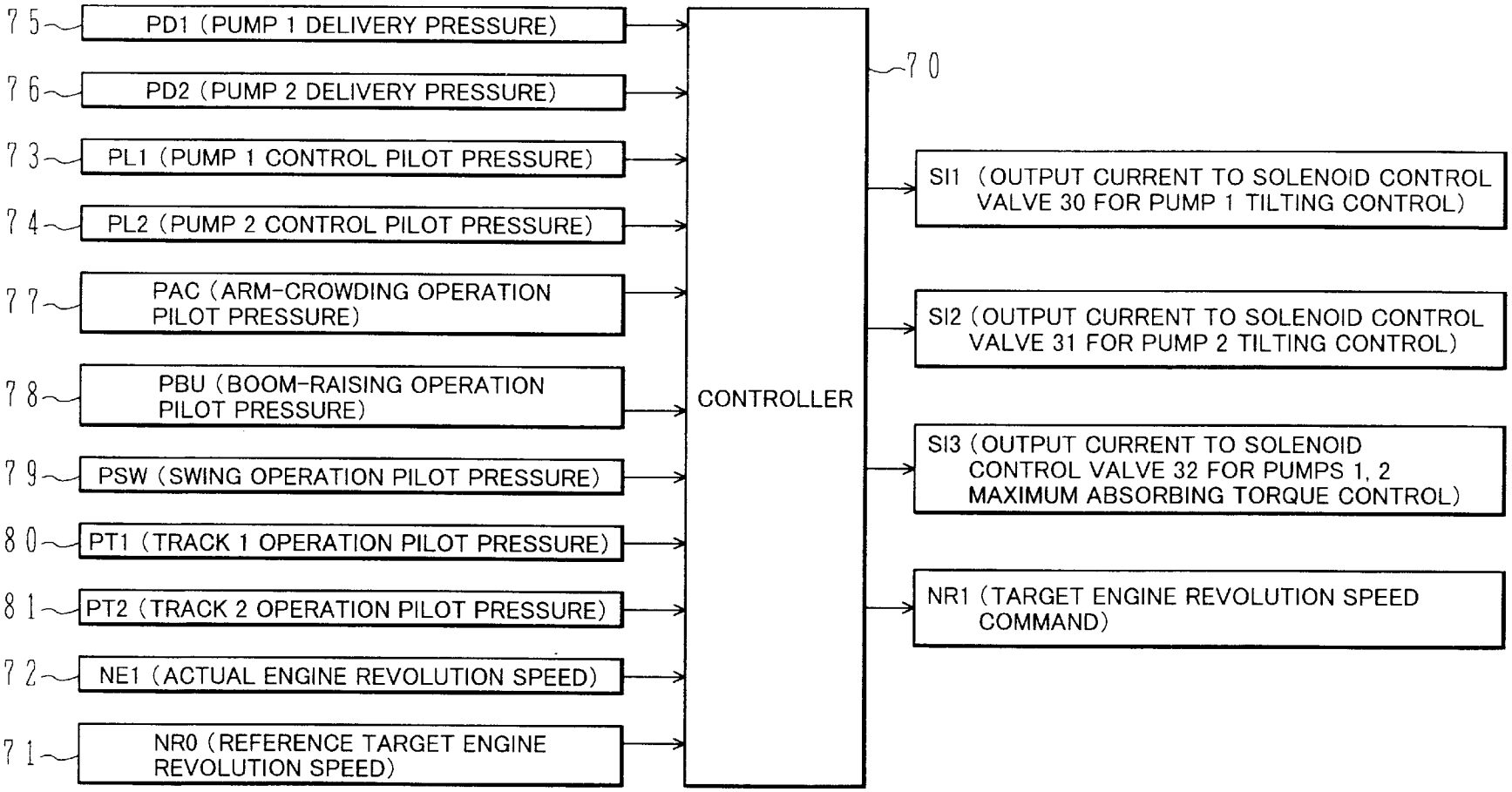
FIG.5
PD1 (PUMP 1 DELIVERY PRESSURE)
PD2 (PUMP 2 DELIVERY PRESSURE)
PL1 (PUMP 1 CONTROL PILOT PRESSURE)
PL2 (PUMP 2 CONTROL PILOT PRESSURE)
PAC (ARM-CROWDING OPERATION PILOT PRESSURE)
PBU (BOOM-RAISING OPERATION PILOT PRESSURE)
PSW (SWING OPERATION PILOT PRESSURE)
PT1 (TRACK 1 OPERATION PILOT PRESSURE)
PT2 (TRACK 2 OPERATION PILOT PRESSURE)
NE1 (ACTUAL ENGINE REVOLUTION SPEED)
NR0 (REFERENCE TARGET ENGINE REVOLUTION SPEED)
CONTROLLER
SI1 (OUTPUT CURRENT TO SOLENOID CONTROL VALVE 30 FOR PUMP 1 TILTING CONTROL)
SI2 (OUTPUT CURRENT TO SOLENOID CONTROL VALVE 31 FOR PUMP 2 TILTING CONTROL)
SI3 (OUTPUT CURRENT TO SOLENOID CONTROL VALVE 32 FOR PUMPS 1, 2 MAXIMUM ABSORBING TORQUE CONTROL)
NR1 (TARGET ENGINE REVOLUTION SPEED COMMAND)
75
76
73
74
77
78
79
80
81
72
71
70

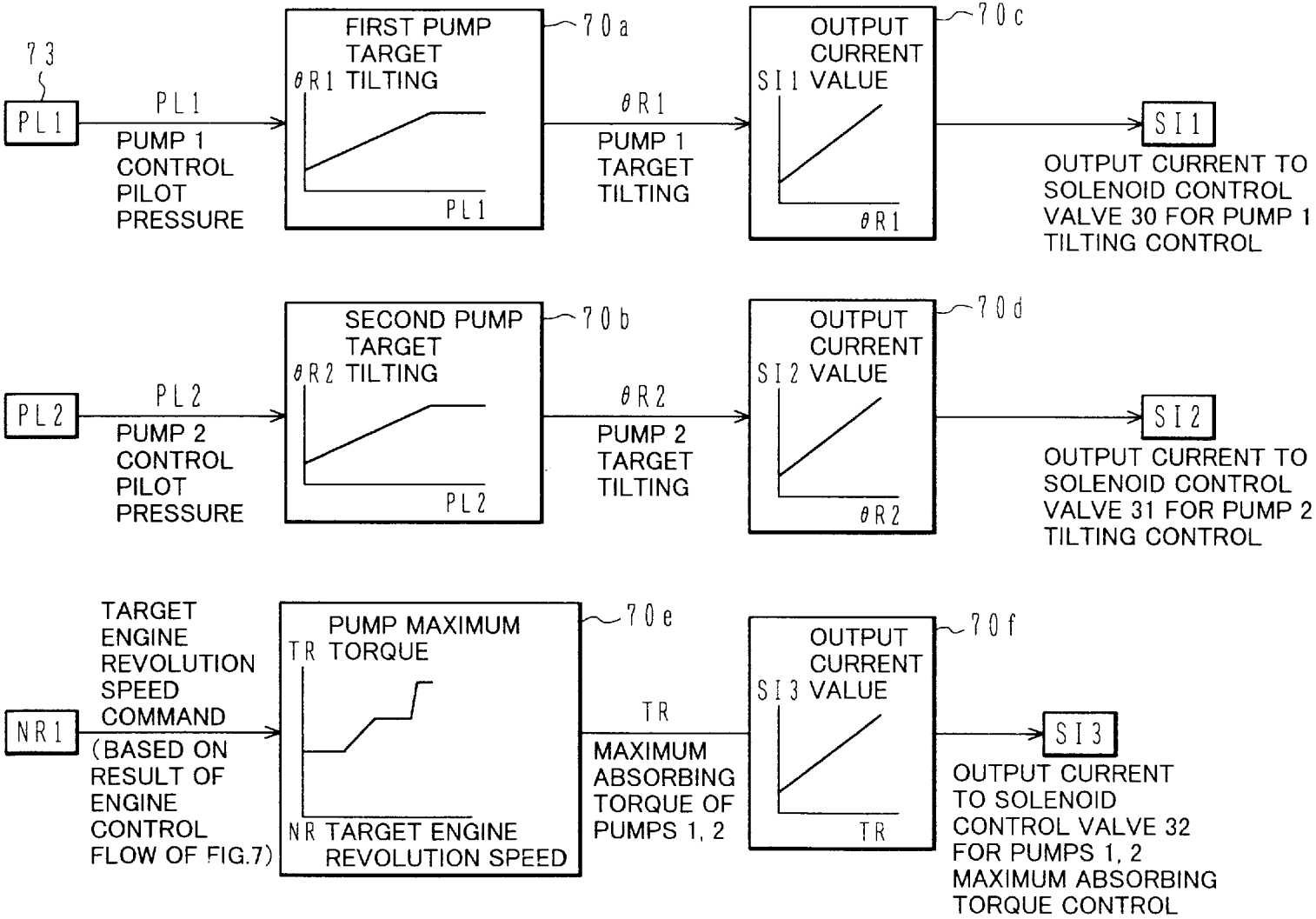
FIG.6
73
PL1
PUMP 1 CONTROL PILOT PRESSURE
70a
FIRST PUMP TARGET TILTING
θR1
PL1
θR1
PUMP 1 TARGET TILTING
70c
OUTPUT CURRENT VALUE
SI1
θR1
SI1
OUTPUT CURRENT TO SOLENOID CONTROL VALVE 30 FOR PUMP 1 TILTING CONTROL
PL2
PUMP 2 CONTROL PILOT PRESSURE
70b
SECOND PUMP TARGET TILTING
θR2
PL2
θR2
PUMP 2 TARGET TILTING
70d
OUTPUT CURRENT VALUE
SI2
θR2
SI2
OUTPUT CURRENT TO SOLENOID CONTROL VALVE 31 FOR PUMP 2 TILTING CONTROL
TARGET ENGINE REVOLUTION SPEED COMMAND
NR1
(BASED ON RESULT OF ENGINE CONTROL FLOW OF FIG.7)
70e
PUMP MAXIMUM TR TORQUE
TR
NR TARGET ENGINE REVOLUTION SPEED
TR
MAXIMUM ABSORBING TORQUE OF PUMPS 1, 2
70f
OUTPUT CURRENT VALUE
SI3
TR
SI3
OUTPUT CURRENT TO SOLENOID CONTROL VALVE 32 FOR PUMPS 1, 2 MAXIMUM ABSORBING TORQUE CONTROL

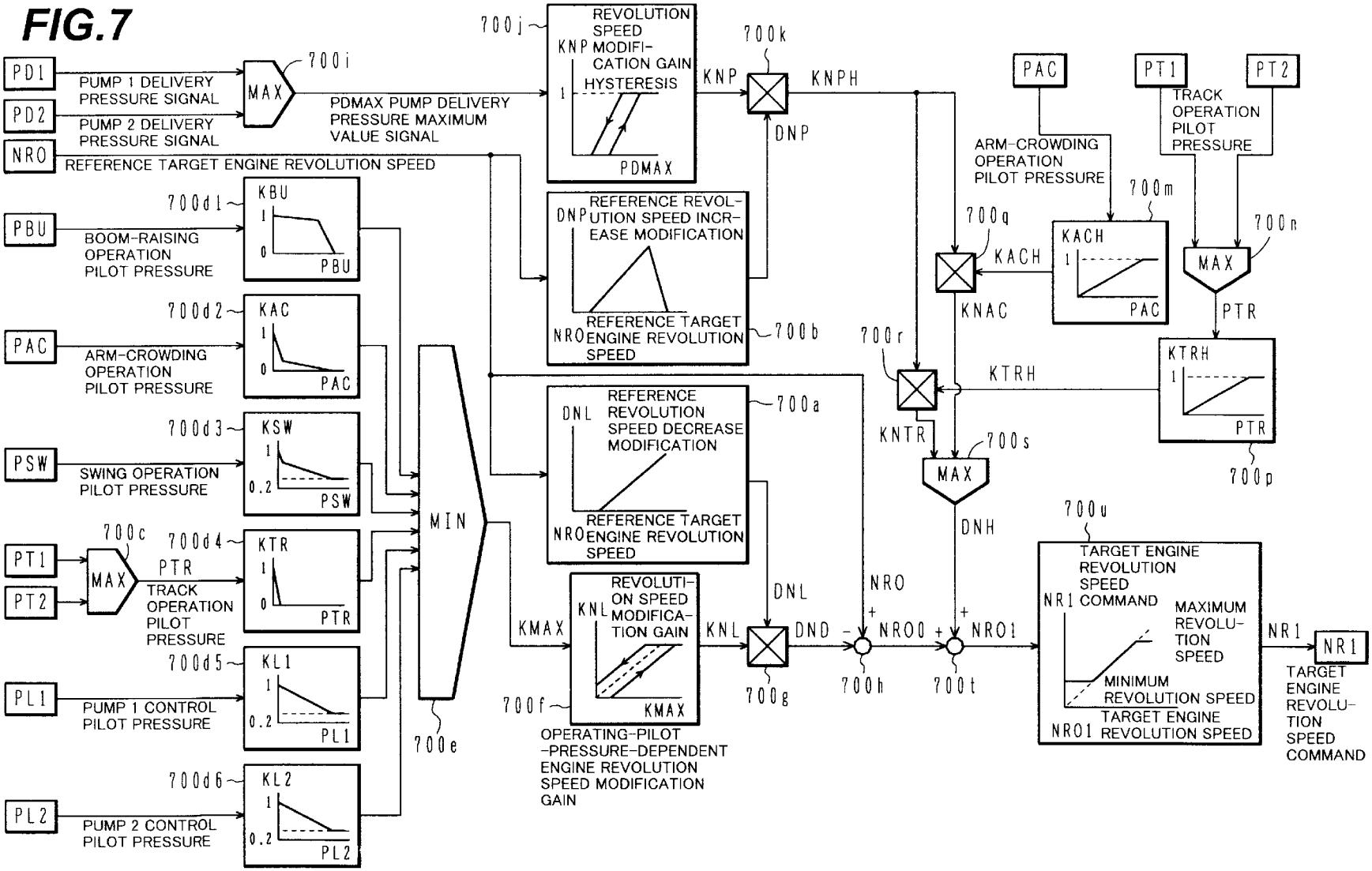
FIG.7
PD1
PD2
NRO
PBU
PAC
PSW
PT1
PT2
PL1
PL2
PUMP 1 DELIVERY PRESSURE SIGNAL
PUMP 2 DELIVERY PRESSURE SIGNAL
REFERENCE TARGET ENGINE REVOLUTION SPEED
BOOM-RAISING OPERATION PILOT PRESSURE
ARM-CROWDING OPERATION PILOT PRESSURE
SWING OPERATION PILOT PRESSURE
TRACK OPERATION PILOT PRESSURE
PUMP 1 CONTROL PILOT PRESSURE
PUMP 2 CONTROL PILOT PRESSURE
MAX
700c
700i
PDMAX PUMP DELIVERY PRESSURE MAXIMUM VALUE SIGNAL
KBU
KAC
KSW
KTR
KL1
KL2
700d1
700d2
700d3
700d4
700d5
700d6
MIN
700e
700j
REVOLUTION SPEED KNP MODIFICATION HYSTERESIS
KNP
PDMAX
700k
KNPH
DNP
700b
REFERENCE REVOLUTION SPEED INCREASE MODIFICATION
DNP
REFERENCE TARGET ENGINE REVOLUTION SPEED
NRO
700a
REFERENCE REVOLUTION SPEED DECREASE MODIFICATION
DNL
REFERENCE TARGET ENGINE REVOLUTION SPEED
NRO
700f
REVOLUTION SPEED KNL MODIFICATION GAIN
KNL
KMAX
OPERATING-PILOT-PRESSURE-DEPENDENT ENGINE REVOLUTION SPEED MODIFICATION GAIN
700g
DNL
DND
700h
NRO
NROO
700t
NRO1
700r
KNTR
700q
KACH
KNAC
700m
KACH
PAC
ARM-CROWDING OPERATION PILOT PRESSURE
700n
MAX
PTR
700p
KTRH
PTR
KTRH
700s
MAX
DNH
700u
TARGET ENGINE REVOLUTION SPEED NR1 COMMAND
MAXIMUM REVOLUTION SPEED
MINIMUM REVOLUTION SPEED
TARGET ENGINE NRO1 REVOLUTION SPEED
NR1
TARGET ENGINE REVOLUTION SPEED COMMAND

AUTO-ACCELERATION SYSTEM FOR PRIME MOVER OF HYDRAULIC CONSTRUCTION MACHINE AND CONTROL SYSTEM FOR PRIME MOVER AND HYDRAULIC PUMP

BACKGROUND OF THE INVENTION

1. Field of the Invention

The present invention relates to a control system for a prime mover and a hydraulic pump of a hydraulic construction machine, and more particularly to an auto-acceleration system for a prime mover of a hydraulic construction machine, such as a hydraulic excavator, wherein hydraulic actuators are operated by a hydraulic fluid delivered from a hydraulic pump, which is driven by an engine for rotation, for carrying out works required.

2. Description of the Prior Art

Generally, in the hydraulic construction machine such as a hydraulic excavator, a diesel engine is provided as a prime mover, at least one variable displacement hydraulic pump is driven by the diesel engine for rotation, and a plurality of hydraulic actuators are operated by a hydraulic fluid delivered from the hydraulic pump for carrying out works required. The diesel engine is provided with input means, such as an accelerator lever, for instructing a target revolution speed. An amount of fuel injected is controlled depending on the target revolution speed, and an engine revolution speed is controlled correspondingly.

For control of the prime mover and the hydraulic pump in such hydraulic construction machine, a control system is proposed in JP, A, 7-119506 entitled "Revolution Speed Control System for Prime Mover of Hydraulic Construction Machine". In the disclosed control system, a target revolution speed is input, as a reference, by operating a fuel lever, and the direction and input amount in and by which control levers or pedals of operation instructing means respectively associated with a plurality of hydraulic actuators are each operated (hereinafter referred to simply as the lever operating direction and lever input amount), as well as an actuator load (pump delivery pressure) are detected. A modification value of the engine revolution speed is determined based on the lever operating direction, the lever input amount and the actuator load, and the target revolution speed is modified using the revolution speed modification value to thereby control the engine revolution speed. In this control system, when the lever input amount is small and when the actuator load is low, the engine target revolution speed is set to a relatively low value for energy saving. When the lever input amount is large and when the actuator load is high, the engine target revolution speed is set to a relatively high value for increasing working efficiency.

SUMMARY OF THE INVENTION

The above prior art has however the problems below.

In the conventional control system, as described above, the target revolution speed is modified based on the operating direction and input amount of the operation instructing means, as well as the actuator load (pump delivery pressure) such that the target revolution speed is always modified to increase or decrease the engine revolution speed if the actuator load is varied regardless of which operation instructing means is operated in which direction. However, there are different types of actuator operations, some of which are more satisfactorily achieved by increasing the engine revolution speed upon an increase in both the lever input amount and the actuator load, but others of which are more satisfactorily achieved by increasing the engine revolution speed upon an increase in the lever input amount alone.

In a hydraulic excavator, for example, an arm is crowded by extending an arm cylinder when excavation work is to be carried out. It is desired that the arm-crowding operation be performed by increasing the engine revolution speed to a higher value under a heavy load than under a light load. This also applies the track operation.

In the boom-raising operation, a working pressure (actuator load) is greatly changed depending on the posture of a front operating mechanism. Even with the lever input amount held fixed, therefore, the engine revolution speed is varied upon change of the actuator load, making the operator feel awkward during the operation.

Thus, the above prior art was poor in operability because the engine revolution speed was varied upon change of the actuator load during the boom-raising operation where the working pressure is greatly changed depending on the posture of the front operating mechanism.

Further, when the reference target revolution speed is set to a low value by the operator, the operator intends to perform the operation slowly. In this case, it is preferable not to increase the engine revolution speed to a large extent even with the actuator load increased.

For example, when leveling the ground rather than excavating, the engine revolution speed is set to a low value. In this case, the engine revolution speed is desirably modified to a small extent upon change of the actuator load and the lever input amount from the convenience for leveling work. This also applies to lifting work.

Thus, the prior art could not achieve satisfactory fine operation because, even in works where the engine revolution speed should be set to a low value, the engine revolution speed was modified upon changes of the actuator load and the lever input amount to such an extent as resulting when the engine revolution speed was high.

A first object of the present invention is to provide an auto-acceleration system for a prime mover of a hydraulic construction machine wherein an engine revolution speed can be controlled depending on change of an actuator load during the operation where an engine revolution speed is desired to become higher as the actuator load increases, and can be controlled depending on only the operating direction and input amount of operation instructing means in other operations, thereby ensuring satisfactory operability.

A second object of the present invention is to provide an auto-acceleration system for a prime mover of a hydraulic construction machine wherein, when a low target revolution speed is input by the operator, a modification width of the engine target revolution speed for changes of the actuator load and the input amount from the operation instructing means is reduced, thereby ensuring satisfactory operability.

(1) To achieve the above first object, according to the present invention, there is provided an auto-acceleration system for a prime mover of a hydraulic construction machine comprising a prime mover, at least one variable displacement hydraulic pump driven by the prime mover, a plurality of hydraulic actuators driven by a hydraulic fluid delivered from the hydraulic pump, operation instructing means for instructing operations of the plurality of hydraulic actuators, first detecting means for detecting command signals from the operation instructing means, second detecting means for detecting loads of the plurality of hydraulic actuators, and input means for instructing a reference target revolution speed of the prime mover, based on values detected by the first and second detecting means to provide a target revolution speed, thereby controlling a revolution speed of the prime mover, wherein the auto-acceleration system comprises first calculating means for calculating, based on the values detected by the first detecting means, a first engine-revolution-speed modification value depending on the direction and amount in and by which the plurality of hydraulic actuators are each operated, second calculating means for modifying, based on the values detected by the first detecting means, the loads detected by the second detecting means depending on the direction and amount in and by which at least one first particular actuator among the plurality of hydraulic actuators is operated, thereby calculating a second engine-revolution-speed modification value, and revolution speed modifying means for modifying the reference target revolution speed using the first engine-revolution-speed modification value and the second engine-revolution-speed modification value, thereby obtaining the target revolution speed.

Thus, the second calculating means modifies the actuator load depending on the direction and amount in and by which the first particular actuator among the plurality of hydraulic actuators is operated, thereby calculating the second engine-revolution-speed modification value, and the revolution speed modifying means modifies the reference target revolution speed using the first engine-revolution-speed modification value, which has been calculated by the first calculating means depending on the direction and amount in and by which the plurality of hydraulic actuators are each operated, and the second engine-revolution-speed modification value, thereby obtaining the target revolution speed. With this feature, control of the engine revolution speed in accordance with change of the actuator load can be performed only upon the operation of the first particular actuator depending on the direction and amount in and by which it is operated. Accordingly, in the operation where the engine revolution speed is desired to become higher as the actuator load increases (e.g., the arm-crowding and track operations of a hydraulic excavator), the engine revolution speed can be controlled in accordance with change of the actuator load as well. In other operations, the engine revolution speed can be controlled just depending on the direction and input amount in and by which the corresponding operation instructing means is operated.

(2) To achieve the above second object, the auto-acceleration system of the present invention further comprises, in addition the above (1), modification value modifying means for calculating reference widths of revolution speed modification for the first and second engine-revolution-speed modification values which are reduced as the reference target revolution speed decreases, and then modifying the first and second engine-revolution-speed modification values in accordance with the reference widths.

Thus, the modification value modifying means is further provided to calculate the reference widths of the revolution speed modification which are reduced as the reference target revolution speed decreases, and then modify the first and second engine-revolution-speed modification values in accordance with the reference widths. In such works as leveling and lifting where the operator carries out the operation by entering a low engine revolution speed, therefore, the modification width of the target engine revolution speed is reduced automatically, enabling the operator to perform fine works more easily.

(3) In the above (1), preferably, the auto-acceleration system further comprises third detecting means for detecting a maximum value of the command signals from the operation instructing means, wherein the first calculating means calculates, based on the values detected by the first detecting means, a first engine-revolution-speed modification reference value depending on the direction and amount in and by which a second particular actuator among the plurality of hydraulic actuators is operated, and calculates, based on the value detected by the third detecting means, a second engine-revolution-speed modification reference value depending on the direction and amount in and by which the plurality of hydraulic actuators are each operated, thereby calculating the first engine-revolution-speed modification value from the first engine-revolution-speed modification reference value and the second engine-revolution-speed modification reference value.

With this feature that the third detecting means detects the maximum value of the command signals from the operation instructing means and the first calculating means calculates, based on the value detected by the third detecting means, the second engine-revolution-speed modification reference value depending on the direction and amount in and by which the plurality of hydraulic actuators are each operated, thereby calculating the first engine-revolution-speed modification value, a revolution speed modification reference value can be calculated using the value detected by the third detecting means, as a representative value, without calculating revolution speed modification reference values for all the actuators depending on the direction and amount in and by which they are each operated. Accordingly, the configuration of a processing unit of the first calculating means can be simplified.

(4) Further, in a control system for a prime mover and a hydraulic pump, comprising the auto-acceleration system according to the above (1), and pump control means for controlling a tilting position and a maximum absorbing torque of the hydraulic pump, preferably, the pump control means determines a target maximum absorbing torque of the hydraulic pump as a function of the target revolution speed modified by the revolution speed modifying means, thereby controlling the maximum absorbing torque of the hydraulic pump.

With this feature that the pump control means controls the maximum absorbing torque of the hydraulic pump as a function of the target revolution speed modified by the revolution speed modifying means, even if the engine revolution speed is varied upon the target revolution speed being modified under control of the engine revolution speed according to the above (1), the maximum absorbing torque of the hydraulic pump is changed automatically in accordance with the modified target revolution speed. As a result, the engine output can be utilized effectively.

(5) In the above (2), preferably, the modification value modifying means modifies said first and second engine-revolution-speed modification values by multiplying the modification values by said reference widths.

With this feature, first and second engine-revolution-speed modification values can be modified such that a modification width of the target engine revolution speed is reduced as the reference width of the revolution speed modification are reduced.

BRIEF DESCRIPTION OF THE DRAWINGS

FIG. 5 is a block diagram showing input/output relations of a controller shown in FIG. 1.

FIG. 6 is a functional block diagram showing processing functions executed in a pump control section of the controller.

FIG. 7 is a functional block diagram showing processing functions executed in an engine control section of the controller.

DESCRIPTION OF THE PREFERRED EMBODIMENT

A preferred embodiment of the present invention will be described hereunder with reference to the drawings. In the following embodiment, the present invention is applied to a control system for a prime mover and hydraulic pumps of a hydraulic excavator.

Figure 1:
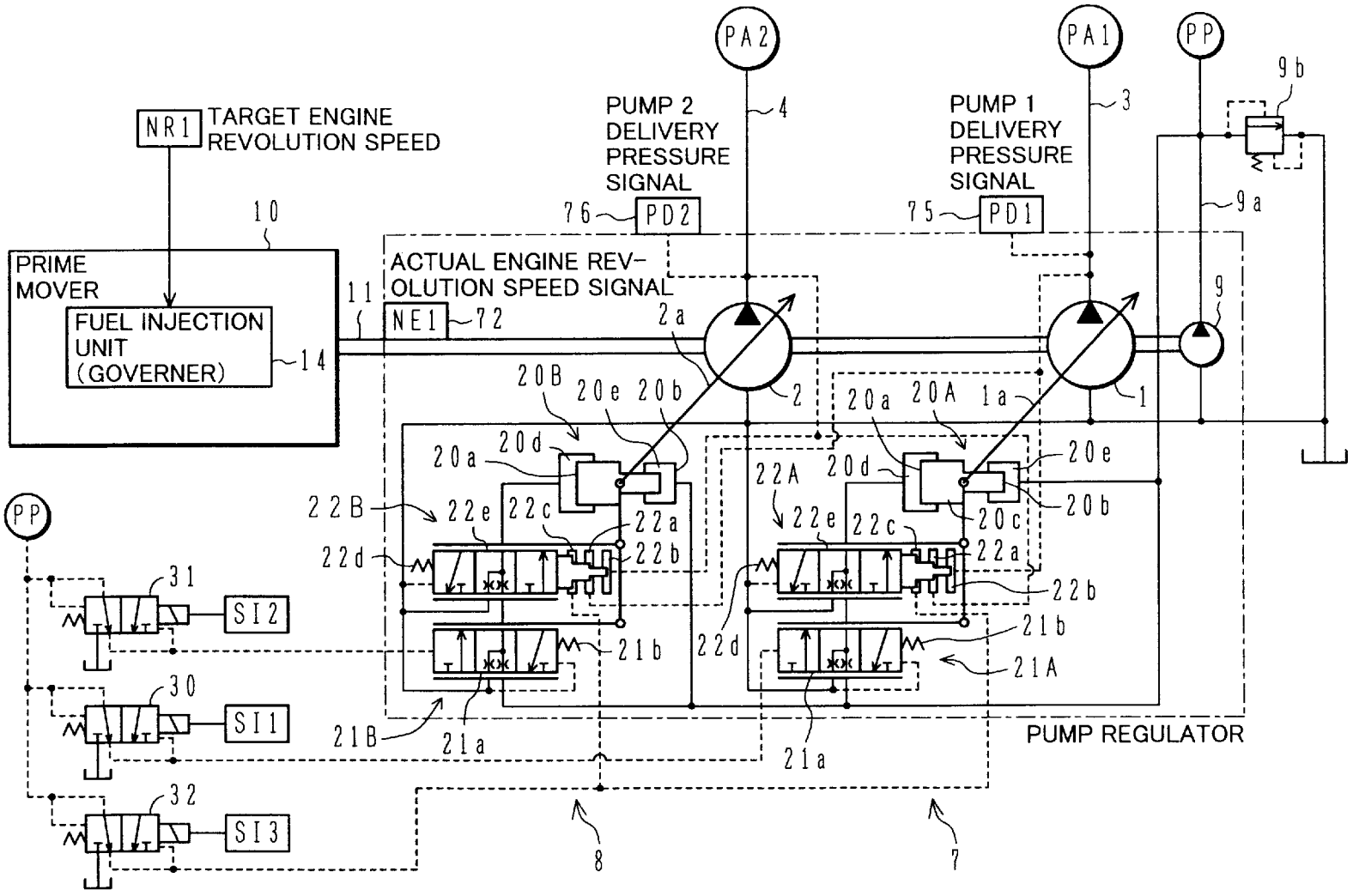
FIG. 1 is a diagram showing a control system for a prime mover and hydraulic pumps, including an auto-acceleration system for the prime mover, according to one embodiment of the present invention.
Figure 2:
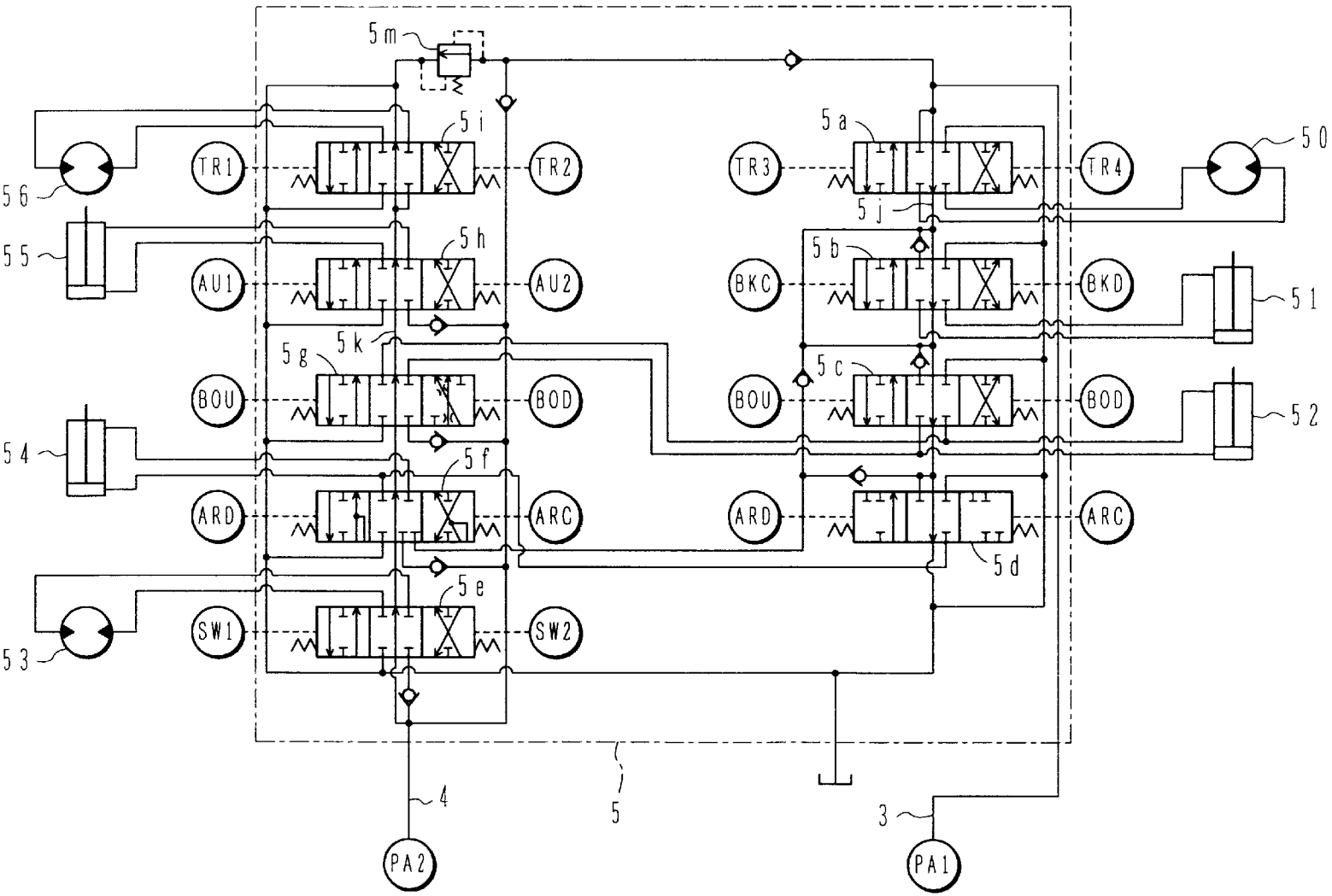
FIG. 2 is a hydraulic circuit diagram of a valve unit and actuators connected to the hydraulic pumps shown in FIG. 1.

In FIG. 1, designated by reference numerals 1 and 2 are variable displacement pumps of swash plate type, for example. A valve unit 5 shown in FIG. 2 is connected to delivery lines 3, 4 of the hydraulic pumps 1, 2, and hydraulic fluids from the hydraulic pumps are delivered to a plurality of actuators 50–56 through the valve unit 5 for operating the actuators.

Denoted by 9 is a fixed displacement pilot pump. A pilot relief valve 9*b* for holding a delivery pressure of the pilot pump 9 at a constant level is connected to a delivery line 9*a* of the pilot pump 9.

The hydraulic pumps 1, 2 and the pilot pump 9 are connected to an output shaft 11 of a prime mover 10 to be driven by the prime mover 10 for rotation.

Details of the valve unit 5 will be described below.

In FIG. 2, the valve unit 5 has two valve groups, i.e., a group of flow control valves 5*a*–5*d* and a group of flow control valves 5*e*–5*i*. The flow control valves 5*a*–5*d* are positioned on a center bypass line 5*j* which is connected to the delivery line 3 of the hydraulic pump 1, and the flow control valves 5*e*–5*i* are positioned on a center bypass line 5*k* which is connected to the delivery line 4 of the hydraulic pump 2. A main relief valve 5*m* for determining a maximum level of the delivery pressures of the hydraulic pumps 1, 2 is disposed in the delivery lines 3, 4.

The flow control valves 5*a*–5*d* and 5*e*–5*i* are center bypass valves. The hydraulic fluids delivered from the hydraulic pumps 1, 2 are supplied to corresponding one or more of the actuators 50–56 through the flow control valves. The actuator 50 is a hydraulic motor for a right track (right track motor), the actuator 51 is a hydraulic cylinder for a bucket (bucket cylinder), the actuator 52 is a hydraulic cylinder for a boom (boom cylinder), the actuator 53 is a hydraulic motor for swing (swing motor), the actuator 54 is a hydraulic cylinder for an arm (arm cylinder), the actuator 55 is a hydraulic cylinder for reserve, and the actuator 56 is a hydraulic motor for a left track (left track motor). The flow control valve 5*a* is for the right track, the flow control valve 5*b* is for the bucket, the flow control valve 5*c* is the first one for the boom, the flow control valve 5*d* is the second one for the arm, the flow control valve 5*e* is for swing, the flow control valve 5*f* is the first one for the arm, the flow control valve 5*g* is the second one for the boom, the flow control valve 5*h* is for reserve, and the flow control valve 5*i* is for the left track. In other words, the two flow control valves 5*g*, 5*c* provided for the boom cylinder 52 and the two flow control valves 5*d*, 5*f* are provided for the arm cylinder 54 so that the hydraulic fluids from the two hydraulic pumps 1*a*, 1*b* are joined together and supplied to the bottom side of each of the boom cylinder 52 and the arm cylinder 54.

Figure 3:
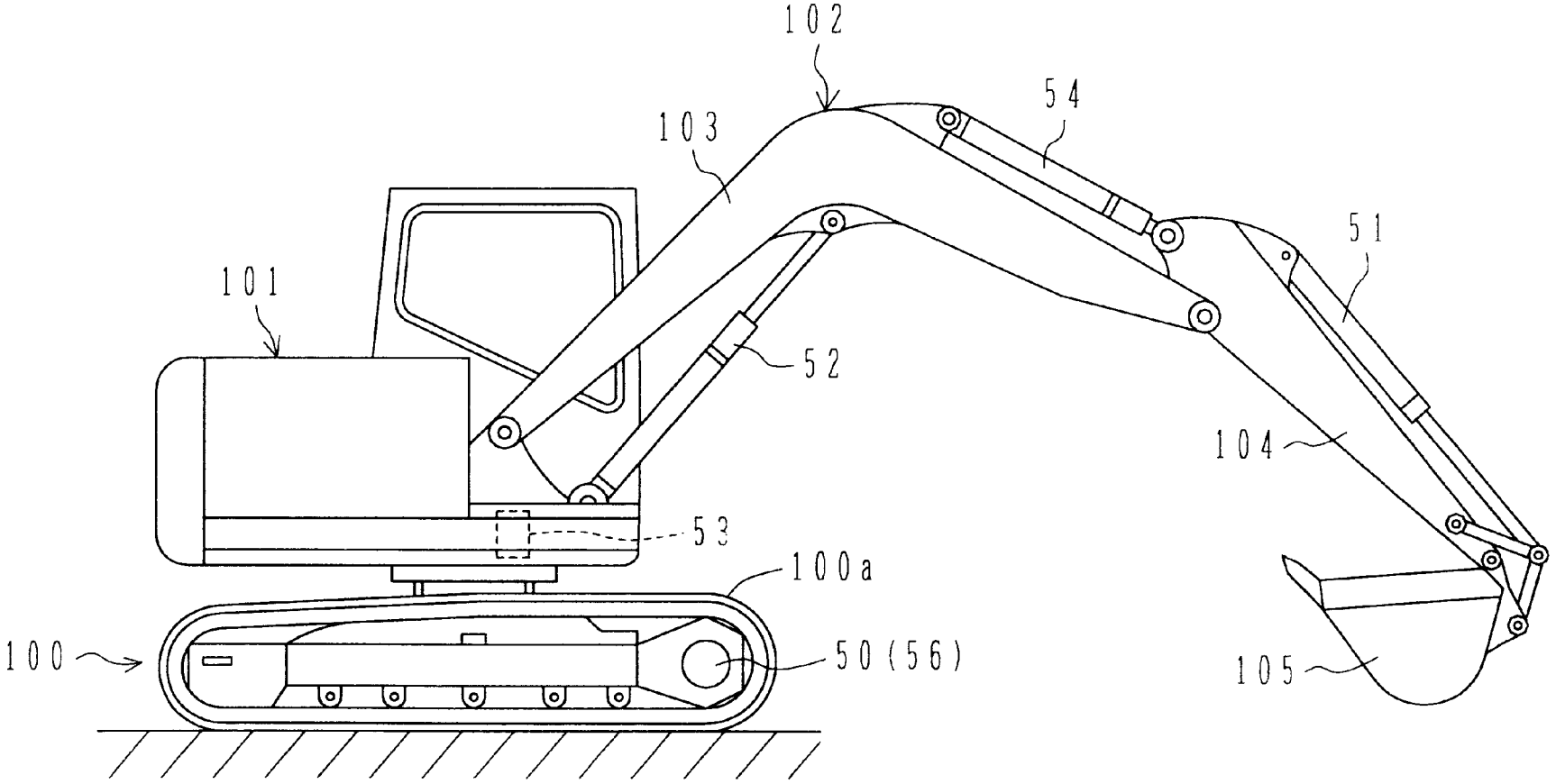
FIG. 3 is a side view showing an appearance of a hydraulic excavator in which the control system for the prime mover and hydraulic pumps, according to the present invention, is installed.

FIG. 3 shows an appearance of a hydraulic excavator in which the control system for the prime mover and the hydraulic pumps, according to the present invention, is installed. The hydraulic excavator is made up of a lower track structure 100, an upper swing structure 101, and a front operating mechanism 102. The right and left track motors 50, 56 are mounted on the lower track structure 100 to drive respective crawlers 100*a* for rotation, whereupon the excavator travels forward or rearward. The swing motor 53 is mounted on the upper swing structure 101 to swing the upper swing structure 101 clockwise or counterclockwise with respect to the lower track structure 100. The front operating mechanism 102 is made up of a boom 103, an arm 104 and a bucket 105. The boom 103 is vertically rotated by the boom cylinder 52, the arm 104 is operated by the arm cylinder 54 to rotate toward the dumping (unfolding) side or the crowding (scooping) side, and the bucket 105 is operated by the bucket cylinder 51 to rotate toward the dumping (unfolding) side or the crowding (scooping) side.

Figure 4:
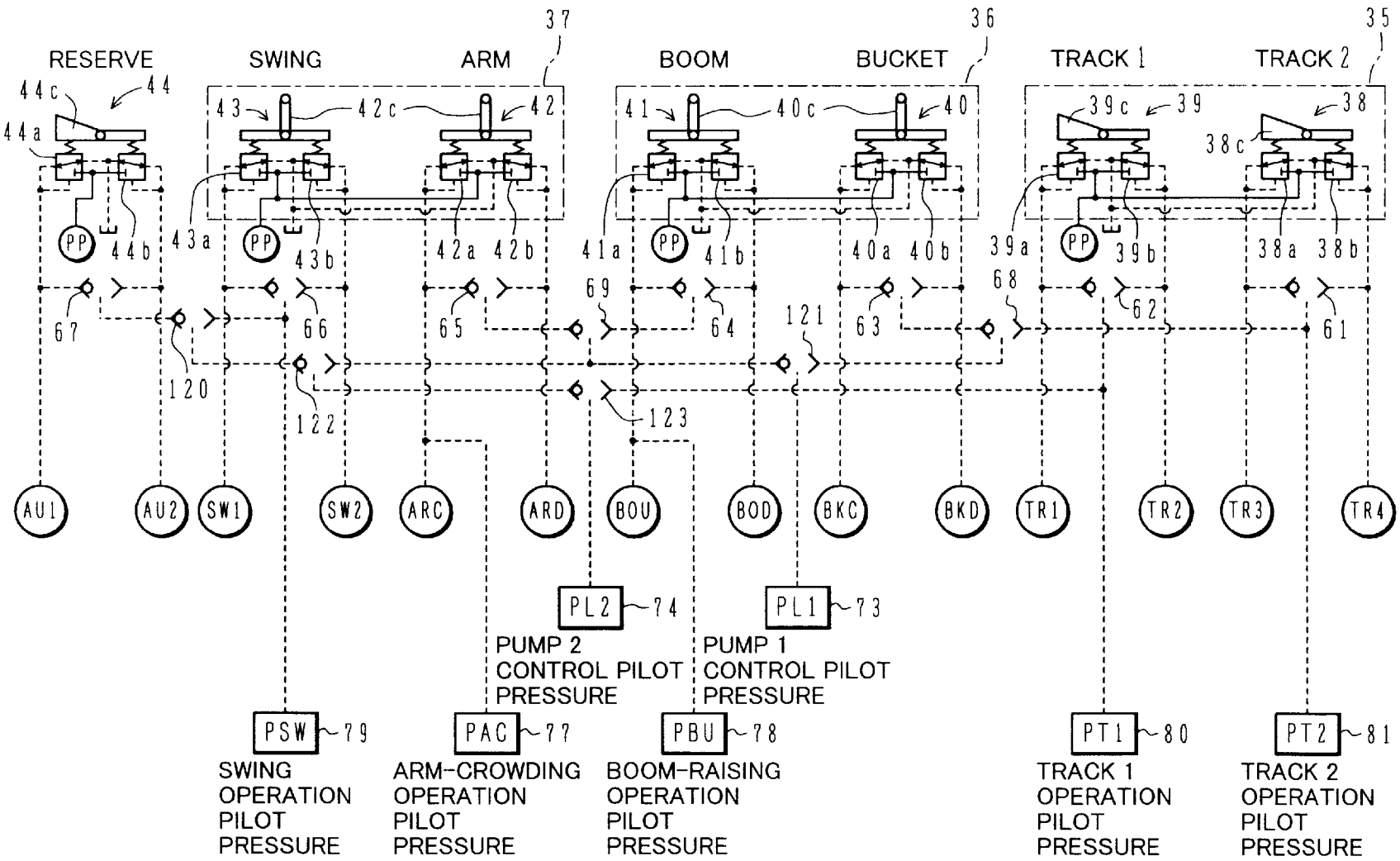
FIG. 4 is a diagram showing an operation pilot system for flow control valves shown in FIG. 2.

FIG. 4 shows an operation pilot system for the flow control valves 5*a*–5*i*.

The flow control valves 5*i*, 5*a* are shifted by operation pilot pressures TR1, TR2; TR3, TR4 from operation pilot devices 39, 38 of an operating unit 35, respectively. The flow control valve 5*b* and the flow control valves 5*c*, 5*g* are shifted by operation pilot pressures BKC, BKD; BOD, BOU from operation pilot devices 40, 41 of an operating unit 38, respectively. The flow control valves 5*d*, 5*f* and the flow control valves 5*e* are shifted by operation pilot pressures ARC, ARD; SW1, SW2 from operation pilot devices 42, 43 of an operating unit 37, respectively. The flow control valve 5*h* is shifted by operation pilot pressures AU1, AU2 from an operating pilot device 44.

The operation pilot devices 38–44 comprise respectively pairs of pilot valves (pressure reducing valves) 38*a*, 38*b*–44*a*, 44*b*. The operation pilot devices 38, 39, 44 further comprise respectively control pedals 38*c*, 39*c*, 44*c*. The operation pilot devices 40, 41 further comprise a common control lever 40*c*, and the operation pilot devices 42, 43 further comprise a common control lever 42*c*. When any of the control pedals 38*c*, 39*c*, 44*c* and the control levers 40*c*, 42*c* is operated, one of the pilot valves of the associated operation pilot device is shifted depending on the direction in which the control pedal or lever is operated, and an operation pilot pressure is generated depending on the input amount by which the control pedal or lever is operated.

Shuttle valves 61–67 are connected to output lines of the respective pilot valves of the operation pilot devices 38–44. Other shuttle valves 68–69 and 120–123 are further connected to the shuttle valves 61–67 in a hierarchical structure. The shuttle valves 61, 63, 64, 65, 68, 69 and 121 cooperatively detect the maximum of the operation pilot pressures from the operation pilot devices 38, 40, 41 and 42 as a control pilot pressure PL1 for the hydraulic pump 1. The shuttle valves 62, 64, 65, 66, 67, 69, 122 and 123 cooperatively detect the maximum of the operation pilot pressures from the operation pilot devices 39, 41, 42, 43 and 44 as a control pilot pressure PL2 for the hydraulic pump 2.

Further, the shuttle valve 61 detects the higher of the operation pilot pressures from the operation pilot device 38 as a pilot pressure for operating the track motor 56 (hereinafter referred to as a track 2 operation pilot pressure PT2). The shuttle valve 62 detects the higher of the operation pilot pressures from the operation pilot device 39 as a pilot pressure for operating the track motor 50 (hereinafter referred to as a track 1 operation pilot pressure PT1). The shuttle valve 66 detects the higher of the operation pilot pressures from the operation pilot device 43 as a pilot pressure PWS for operating the swing motor 53 (hereinafter referred to as a swing operation pilot pressure).

The control system for the prime mover and the hydraulic pumps, including an auto-acceleration system, according to the present invention is installed in the hydraulic drive system described above. Details of the control system will be described below.

Returning to FIG. 1, the hydraulic pumps 1, 2 are provided with regulators 7, 8 for controlling tilting positions of swash plates 1*a*, 2*a* of capacity varying mechanisms for the hydraulic pumps 1, 2, respectively.

The regulators 7, 8 of the hydraulic pumps 1, 2 comprise, respectively, tilting actuators 20A, 20B (hereinafter represented simply by 20), first servo valves 21A, 21B (hereinafter represented simply by 21) for positive tilting control based on the operation pilot pressures from the operation pilot devices 38–44 shown in FIG. 4, and second servo valves 22A, 22B (hereinafter represented simply by 22) for total horsepower control of the hydraulic pumps 1, 2. These servo valves 21, 22 control the pressure of a hydraulic fluid delivered from the pilot pump 9 and acting on the tilting actuators 20, thereby controlling the tilting positions of the hydraulic pumps 1, 2.

Details of the tilting actuators 20 and the first and second serve valves 21, 22 will now be described.

The tilting actuators 20 each comprise an operating piston 20*c* provided with a large-diameter pressure bearing portion 20*a* and a small-diameter pressure bearing portion 20*b* at opposite ends thereof, and pressure bearing chambers 20*d*, 20*e* in which the pressure bearing portions 20*a*, 20*b* are positioned respectively. When pressures in both the pressure bearing chambers 20*d*, 20*e* are equal to each other, the operating piston 20*c* is moved to the right on the drawing, whereupon the tilting of the swash plate 1*a* or 2*a* is diminished to reduce the pump delivery rate. When the pressure in the large-diameter pressure bearing chamber 20*d* lowers, the operating piston 20*c* is moved to the left on the drawing, whereupon the tilting of the swash plate 1*a* or 2*a* is enlarged to increase the pump delivery rate. Further, the large-diameter pressure bearing chamber 20*d* is connected to a delivery line 9*a* of the pilot pump 9 through the first and second servo valves 21, 22, whereas the small-diameter pressure bearing chamber 20*e* is directly connected to the delivery line 9*a* of the pilot pump 9.

The first servo valves 21 for positive tilting control are each a valve operated by a control pressure from a solenoid control valve 30 or 31 for controlling the tilting position of the hydraulic pump 1 or 2. When the control pressure is high, a valve body 21*a* is moved to the right on the drawing, causing the pilot pressure from the pilot pump 9 to be transmitted to the pressure bearing chamber 20*d* without being reduced, whereby the tilting of the hydraulic pump 1 or 2 is reduced. As the control pressure lowers, the valve body 21*a* is moved to the left on the drawing by the force of a spring 21*b*, causing the pilot pressure from the pilot pump 9 to be transmitted to the pressure bearing chamber 20*d* after being reduced, whereby the tilting of the hydraulic pump 1 or 2 is increased.

The second servo valves 22 for total horsepower control are each a valve operated by the delivery pressures of the hydraulic pumps 1, 2 and a control pressure from a solenoid control valve 32, thereby effecting the total horsepower control for the hydraulic pumps 1, 2. A maximum absorbing torque of the hydraulic pumps 1, 2 is limit-controlled in accordance with the control pressure from the solenoid control valve 32.

More specifically, the delivery pressures of the hydraulic pumps 1, 2 and the control pressure from the solenoid control valve 32 are introduced respectively to pressure bearing chambers 22*a*, 22*b*, 22*c* in an operation drive sector of the second servo valve 22. When the sum of hydraulic pressure forces given by the delivery pressures of the hydraulic pumps 1 and 2 is lower than a setting value which is determined by a difference between-the resilient force of a spring 22*d* and hydraulic pressure force given by the control pressure introduced to the pressure bearing chamber 22*c*, a valve body 22*e* is moved to the right on the drawing, causing the pilot pressure from the pilot pump 9 to be transmitted to the pressure bearing chamber 20*d* after being reduced, whereby the tilting of the hydraulic pump 1 or 2 is increased. As the sum of hydraulic pressure forces given by the delivery pressures of the hydraulic pumps 1 and 2 rises over the setting value, the valve body 22*e* is moved to the left on the drawing, causing the pilot pressure from the pilot pump 9 to be transmitted to the pressure bearing chamber 20*d* without being reduced, whereby the tilting of the hydraulic pump 1 or 2 is reduced. Further, when the control pressure from the solenoid control valve 32 is low, the setting value is increased so that the tilting of the hydraulic pump 1 or 2 starts reducing from a relatively high delivery pressure of the hydraulic pump 1 or 2, and as the control pressure from the solenoid control valve 32 rises, the setting value is decreased so that the tilting of the hydraulic pump 1 or 2 starts reducing from a relatively low delivery pressure of the hydraulic pump 1 or 2.

The solenoid control valves 30, 31, 32 are proportional pressure reducing valves operated by drive currents SI1, SI2, SI3, respectively, such that the control pressures output from them are maximized when the drive currents SI1, SI2, SI3 are minimum, and are lowered as the drive currents SI1, SI2, SI3 increase. The drive currents SI1, SI2, SI3 are output from a controller 70 shown in FIG. 7.

The prime mover 10 is a diesel engine and includes a fuel injection unit 14. The fuel injection unit 14 has a governor mechanism and controls the engine revolution speed to become coincident with a target engine revolution speed NR1 based on an output signal from the controller 70 shown in FIG. 5.

There are several types of governor mechanisms for use in the fuel injection unit, e.g., an electronic governor control unit for effecting control to achieve the target engine revolution speed directly based on an electric signal from the controller, and a mechanical governor control unit in which a motor is coupled to a governor lever of a fuel injection pump and a position of the governor lever is controlled by driving the motor in accordance with a command value from the controller so that the governor lever takes a predetermined position at which the target engine revolution speed is achieved. The fuel injection unit 14 in this embodiment may be any suitable type.

The prime mover 10 is provided with a target engine-revolution-speed input unit 71 through which the operator manually enters a reference target engine revolution speed NR0, as shown in FIG. 5. An input signal of the reference target engine revolution speed NR0 is taken into the controller 70. The target engine-revolution-speed input unit 71 may comprise electric input means, such as a potentiometer, for directly entering the signal to the controller 70, thus enabling the operator to select the magnitude of the target engine revolution speed as a reference. The reference target engine revolution speed NR0 is generally set to be large for heavy excavation work and small for light works.

As shown in FIG. 1, there are provided a revolution speed sensor 72 for detecting an actual revolution speed NE1 of the prime mover 10, and pressure sensors 75, 76 for detecting delivery pressures PD1, PD2 of the hydraulic pumps 1, 2. Further, as shown in FIG. 4, there are provided pressure sensors 73, 74 for detecting the control pilot pressures PL1, PL2 for the hydraulic pumps 1, 2, a pressure sensor 77 for detecting an arm-crowding operation pilot pressure PAC, a pressure sensor 78 for detecting an boom-raising operation pilot pressure PBU, a pressure sensor 79 for detecting the swing operation pilot pressure PWS, a pressure sensor 80 for detecting the track 1 operation pilot pressure PT1, and a pressure sensor 81 for detecting the track 2 operation pilot pressure PT2.

FIG. 5 shows input/output relations of all signals to and from the controller 70. The controller 70 receives the signal of the reference target engine revolution speed NR0 from the target engine-revolution-speed input unit 71, a signal of the actual revolution speed NE1 from the revolution speed sensor 72, signals of the pump control pilot pressures PL1, PL2 from the pressure sensors 73, 74, signals of the delivery pressures PD1, PD2 of the hydraulic pumps 1, 2 from the pressure sensors 75, 76, as well as signals of the arm-crowding operation pilot pressure PAC, the boom-raising operation pilot pressure PBU, the swing operation pilot pressure PWS, the track 1 operation pilot pressure PT1, and the track 2 operation pilot pressure PT2 from the pressure sensors 77–81. After executing predetermined arithmetic operations, the controller 70 outputs the drive currents SI1, SI2, SI3 to the solenoid control valves 30–32, respectively, for controlling the tilting positions, i.e., the delivery rates, of the hydraulic pumps 1, 2, and also outputs a signal of the target engine revolution speed NR1 to the fuel injection unit 14 for controlling the engine revolution speed.

FIG. 6 shows processing functions executed by the controller 70 for control of the hydraulic pumps 1, 2.

In FIG. 6, the controller 70 has functions of pump target tilting calculating portions 70*a*, 70*b*, solenoid output current calculating portions 70*c*, 70*d*, a pump maximum absorbing torque calculating portion 70*e*, and a solenoid output current calculating portion 70*f*.

The pump target tilting calculating portion 70*a* receives the signal of the control pilot pressures PL1 for the hydraulic pump 1, and calculates a target tilting θR1 of the hydraulic pump 1 corresponding to the control pilot pressures PL1 at that time by referring to a PL1–θR1 table stored in a memory. The target tilting θR1 is used as a reference flow metering value for positive tilting control in accordance with the input amounts from the operation pilot devices 38, 40, 41 and 42, and an actual flow metering value is provided by multiplying the target tilting θR1 by a pump revolution speed and a constant. In the memory table, a relationship between PL1 and θR1 is set such that the target tilting θR1 is increased as the control pilot pressure PL1 rises.

The solenoid output current calculating portion 70*c* calculates the drive current SI1 for use in tilting control of the hydraulic pump 1 to provide the target tilting θR1, and outputs the drive current SI1 to the solenoid control valve 30.

Likewise, the pump target tilting calculating portion 70*b* and the solenoid output current calculating portion 70*d* cooperatively calculate the drive current SI2 for tilting control of the hydraulic pump 2 from the pump control signal PL2, and output the drive current SI2 to the solenoid control valve 31.

The pump maximum absorbing torque calculating portion 70*e* receives the signal of the target engine revolution speed NR1 (described later in more detail) and calculates a maximum absorbing torque TR of the hydraulic pumps 1, 2 corresponding to the target engine revolution speed NR1 at that time by referring to an NR1–TR table stored in a memory. The maximum absorbing torque TR is an absorbing torque of the hydraulic pumps 1, 2 in match with an output torque characteristic of the engine 10 rotating at the target engine revolution speed NR1. In the memory table, a relationship between NR1 and TR is set such that the pump maximum absorbing torque TR is increased as the target engine revolution speed NR1 rises.

The solenoid output current calculating portion 70*f* calculates the drive current SI3 of the solenoid control valve 32 for use in maximum absorbing torque control of the hydraulic pumps 1, 2 to provide the pump maximum absorbing torque TR, and outputs the drive current SI3 to the solenoid control valve 32.

FIG. 7 shows processing functions executed by the controller 70 for control of the engine 10.

In FIG. 7, the controller 70 has functions of a reference-revolution-speed decrease modification calculating portion 700*a*, a reference-revolution-speed increase modification calculating portion 700*b*, a maximum value selecting portion 700*c*, an engine-revolution-speed modification gain calculating portions 700*d*1–700*d*6, a minimum value selecting portion 700*e*, a hysteresis calculating portion 700*f*, an operation-pilot-pressure-dependent engine revolution speed modification calculating portion 700*g*, a first reference target-engine-revolution-speed modifying portion 700*h*, a maximum value selecting portion 700*i*, a hysteresis calculating portion 700*j*, a pump-delivery-pressure signal modifying portion 700*k*, a modification gain calculating portion 700*m*, a maximum value selecting portion 700*n*, a modification gain calculating portion 700*p*, a first pump-delivery-pressure-dependent engine-revolution-speed modification calculating portion 700*q*, a second pump-delivery-pressure-dependent engine-revolution-speed modification calculating portion 700*r*, a maximum value selecting portion 700*s*, a second reference target-engine-revolution-speed modifying portion 700*t*, and a limiter calculating portion 700*u*.

The reference-revolution-speed decrease modification calculating portion 700*a* receives the signal of the reference target engine revolution speed NR0 from the target engine-revolution-speed input unit 71, and calculates a reference-revolution-speed decrease modification DNL corresponding to the NR0 at that time by referring to an NR0–DNL table stored in a memory. The DNL serves as a reference width of the engine revolution speed modification in accordance with changes of the inputs from the control levers or pedals of the operation pilot devices 38–44 (i.e., change in any operation pilot pressure). Because the revolution speed modification is desired to become smaller as the target engine revolution speed decreases, the memory table stores a relationship between NR0 and DNL set such that the reference-revolution-speed decrease modification DNL is reduced as the reference target engine revolution speed NR0 decreases.

Similarly to the calculating portion 700*a*, the reference-revolution-speed increase modification calculating portion

700*b* receives the signal of the reference target engine revolution speed NR0 and calculates a reference-revolution-speed increase modification DNP corresponding to the NR0 at that time by referring to an NR0–DNP table stored in a memory. The DNP serves as a reference width of the engine revolution speed modification in accordance with input change of the pump delivery pressure. Because the revolution speed modification is desired to become smaller as the target engine revolution speed decreases, the memory table stores a relationship between NR0 and DNP set such that the reference-revolution-speed increase modification DNP is reduced as the reference target engine revolution speed NR0 decreases. Incidentally, the engine revolution speed cannot be increased over a specific maximum revolution speed. The increase modification DNP is therefore reduced near a maximum value of the reference target engine revolution speed NR0.

The maximum value selecting portion 700*c* selects the higher of the track 1 operation pilot pressure PT1 and the track 2 operation pilot pressure PT2, and outputs it as a track operation pilot pressure PTR.

The engine-revolution-speed modification gain calculating portions 700*d*1–700*d*6 receive the signals of the boom-raising operation pilot pressure PBU, the arm-crowding operation pilot pressure PAC, the swing operation pilot pressure PWS, the track operation pilot pressure PTR and the pump control pilot pressures PL1, PL2, and calculate engine-revolution-speed modification gains KBU, KAC, KSW, KTR, KL1 and KL2 corresponding to the received operation pilot pressures at that time by referring to respective tables stored in memories. These modification gains are each used for calculating a revolution speed modification component (an engine-revolution-speed decrease modification DND) which is subtracted from the reference target engine revolution speed NR0 (as described later). A resulting target revolution speed is reduced as the modification gain increases. Also, it is required that the target revolution speed be increased with an increase of the pilot pressure. Accordingly, all the modification gains KBU, KAC, KSW, KTR, KL1 and KL2 are set to a maximum value 1 when the pilot pressure is 0.

The calculating portions 700*d*1–700*d*4 each serve to preset change of the engine revolution speed with respect to change of the input from the control lever or pedal (i.e., change of the operation pilot pressure) associated with the actuator to be operated correspondingly, for the purpose of facilitating the operation. The engine-revolution-speed modification gains KBU, KAC, KSW, KTR, KL1 and KL2 are set as follows.

The boom-raising operation is employed in many cases in a fine operating range as required for position alignment in lifting and leveling works. In the fine operating range of the boom-raising operation, therefore, the engine revolution speed is reduced and the gain slope is made small.

When the arm-crowding operation is employed. in excavation work, the control lever is operated to a full stroke in many cases. To reduce variations of the revolution speed near the full lever stroke, therefore, the gain slope is made small near the full lever stroke.

For the swing operation, to reduce variations of the revolution speed in an intermediate range, the gain slope in the intermediate range is made small.

In the track operation, since powerful propulsion is required from a fine operating range, the engine revolution speed is set to a relatively high value from the fine operating range.

The engine revolution speed at the full lever stroke is also variable for each of the actuators. For example, in the boom-raising and arm-crowding operations which require a large flow rate, the engine revolution speed is set to a relatively high value. In other operations, the engine revolution speed is set to a relatively low value. In the track operation, the engine revolution speed is set to a relatively high value to increase the traveling speed of the excavator.

The memory tables in the calculating portions 700*d*1–700*d*4 store relationships between the operation pilot pressures and the modification gains KBU, KAC, KSW and KTR set corresponding to the above conditions.

More specifically, the memory table in the calculating portion 700*d*1 stores a relationship between PBU and KBU set such that when the boom-raising operation pilot pressure PBU is in a low range, the modification gain KBU is increased toward 1 at a small slope as the pilot pressure PBU lowers, and when the pilot pressure PBU is raised to a value near the maximum level, the modification gain KBU becomes 0.

The memory table in the calculating portion 700*d*2 stores a relationship between PAC and KAC set such that when the arm-crowding operation pilot pressure PAC is in a high range, the modification gain KAC is decreased toward 0 at a small slope as the pilot pressure PAC rises.

The memory table in the calculating portion 700*d*3 stores a relationship between PSW and KSW set such that when the swing operation pilot pressure PSW is in a range near an intermediate pressure, the modification gain KSW is decreased toward 0.2 at a small slope as the pilot pressure PSW rises.

The memory table in the calculating portion 700*d*4 stores a relationship between PTR and KTR set such that when the track operation pilot pressure PTR is in a fine operating range or higher range, the modification gain KTR is 0.

Further, the pump control pilot pressures PL1, PL2 input to the calculating portions 700*d*5, 700*d*6 are given as the maximums of the associated operation pilot pressures.

The engine-revolution-speed modification gains KL1, KL2 are calculated from the pump control pilot pressures PL1, PL2 which are each representative of all the associated operation pilot pressures.

It is generally desired that the engine revolution speed be increased as the operation pilot pressure (input amount from the control lever or pedal) rises. The memory tables in the calculating portions 700*d*5, 700*d*6 store relationships between the pump control pilot pressures PL1, PL2 and the modification gains KL1, KL2 set in consideration of such a desire. Also, the minimum value selecting portion 700*e* selects a minimum value with reference given to the calculating portions 700*d*1–700*d*4. To this end, the modification gains KL1, KL2 are set to a value somewhat larger than 0, i.e., 0.2, in ranges near maximum levels of the pump control pilot pressures PL1, PL2.

The minimum value selecting portion 700*e* selects the minimum of the modification gains calculated by the calculating portions 700*d*1–700*d*6, and then outputs it as KMAX. Here, in the operation other than the boom-raising, arm-crowding, swing and track operations, the engine-revolution-speed modification gains KL1, KL2 are calculated from the pump control pilot pressures PL1, PL2 as representative values and are then selected as KMAX.

The hysteresis calculating portion 700*f* gives a hysteresis to the KMAX, and an obtained result is output as an engine-revolution-speed modification gain KNL depending on the operation pilot pressure.

The operation-pilot-pressure-dependent engine revolution speed modification calculating portion 700*g* multiples the engine-revolution-speed modification gain KNL by the reference-revolution-speed decrease modification DNL mentioned above, thus calculating an engine-revolution-speed decrease modification DND in accordance with input change of the operation pilot pressure.

The first reference target-engine-revolution-speed modifying portion 700*h* subtracts the engine-revolution-speed decrease modification DND from the reference target engine revolution speed NR0, thereby providing a target revolution speed NR00. The target revolution speed NR00 is a target engine revolution speed after being modified depending on the operation pilot pressure.

The maximum value selecting portion 700*i* receives the signals of the delivery pressures PD1, PD2 of the hydraulic pumps 1, 2 and selects the higher of the delivery pressures PD1, PD2, thereby providing it as a pump delivery pressure maximum value signal PDMAX.

The hysteresis calculating portion 700*j* gives a hysteresis to the pump delivery pressure maximum value signal PDMAX, and an obtained result is output as an engine-revolution-speed modification gain KNP depending on the pump delivery pressure.

The pump-delivery-pressure signal modifying portion 700*k* multiples the revolution-speed-modification gain KNP by the reference-revolution-speed increase modification DNP mentioned above, thus calculating an engine revolution basic modification KNPH depending on the pump delivery pressure.

The modification gain calculating portion 700*m* receives the signal of the arm-crowding operation pilot pressure PAC and calculates an engine-revolution-speed modification gain KACH corresponding to the operation pilot pressure PAC at that time by referring to a PAC–KACH table stored in a memory. Because a larger flow rate is required as an input amount for the arm-crowding operation increases, the memory table stores a relationship between PAC and KACH set such that the modification gain KACH is increased as the arm-crowding operation pilot pressure PAC rises.

Similarly to the maximum value selecting portion 700*c*, the maximum value selecting portion 700*n* selects the higher of the track 1 operation pilot pressure PT1 and the track 2 operation pilot pressure PT2, and outputs it as a track operation pilot pressure PTR.

The modification gain calculating portion 700*p* receives a signal of the track operation pilot pressure PTR and calculates an engine-revolution-speed modification gain KTRH corresponding to the operation pilot pressure PTR at that time by referring to a PTR-KTRH table stored in a memory.

Also in this case, because a larger flow rate is required as an input amount for the track operation increases, the memory table stores a relationship between PTR and KTRH set such that the modification gain KTRH is increased as the track operation pilot pressure PTR rises.

The first and second pump-delivery-pressure-dependent engine-revolution-speed modification calculating portions 700*q*, 700*r* multiply the pump-delivery-pressure-dependent engine revolution basic modification KNPH by the modification gains KACH, KTRH, thus calculating engine-revolution-speed modifications KNAC, KNTR, respectively.

The maximum value selecting portion 700*s* selects the larger of the engine-revolution-speed modifications KNAC, KNTR and outputs it as a modification DNH. This modification DNH represents an engine-revolution-speed increase modification in accordance with input changes of the pump delivery pressure and the operation pilot pressure.

The above-mentioned process, in which the engine revolution basic modification KNPH is multiplied by the modification gain KACH or KTRH to calculate the engine-revolution-speed modification KNAC or KNTR in the calculating portion 700*q* or 700*r*, means that the engine revolution speed is modified to increase depending on the pump delivery pressure only in the arm-crowding and track operations. Thus, only in the arm-crowding and track operations where the engine revolution speed is desired to become higher as the actuator load increases, the engine revolution speed can be increased with a rise of the pump delivery pressure.

The second reference target-engine-revolution-speed modifying portion 700*t* adds the engine revolution speed increase modification DNH to the aforesaid target revolution speed NR00, thereby calculating a target engine revolution speed NR01.

The limiter calculating portion 700*u* imposes limits on the target engine revolution speed NR01 in accordance with maximum and minimum revolution speeds specific to the engine, thereby calculating a target engine revolution speed NR1 which is sent to the fuel injection unit 14 (see FIG. 1). The target engine revolution speed NR1 is also sent to the pump maximum absorbing torque calculating portion 70*e* (see FIG. 6) provided in the controller 70 for control of the hydraulic pumps 1, 2.

In the above description, the operation pilot devices 38–44 constitute operation instructing means for instructing the operation of the plurality of hydraulic actuators 50–56. The pressure sensors 73, 74 and 77–81 constitute first detecting means for detecting command signals from the operation instructing means, and the pressure sensors 75, 76 constitute second detecting means for detecting loads of the plurality of hydraulic actuators 75, 76. The target engine-revolution-speed input unit 71 constitutes input means for instructing the reference target engine revolution speed NR0 of the prime mover 10.

Further, the modification gain calculating portions 700*d*1–700*d*6, the minimum value selecting portion 700*e*, the hysteresis calculating portion 700*f*, and the operation-pilot-pressure-dependent engine revolution speed modification calculating portion 700*g* constitute first calculating means for calculating, based on values detected by the first detecting means, a first engine-revolution-speed modification value (engine-revolution-speed decrease modification DND) depending on the direction and amount in and by which the plurality of hydraulic actuators 50–56 are each operated. The maximum value selecting portion 700*i*, the hysteresis calculating portion 700*j*, the pump-delivery-pressure signal modifying portion 700*k*, the modification gain calculating portion 700*m*, the maximum value selecting portion 700*n*, the modification gain calculating portion 700*p*, the first pump-delivery-pressure-dependent engine-revolution-speed modification calculating portion 700*q*, the second pump-delivery-pressure-dependent engine-revolution-speed modification calculating portion 700*r*, and the maximum value selecting portion 700*s* constitute second calculating means for modifying the loads detected by the second detecting means depending on the direction and amount in and by which first particular actuators 54; 50, 56 among the plurality of hydraulic actuators 50–56 are each operated, thereby calculating a second engine-revolution-speed modification value (engine-revolution-speed increase modification DNH). The first reference target-engine-revolution-speed modifying portion 700*h* and the second reference target-engine-revolution-speed modifying portion 700*t* constitute revolution speed modifying means for modifying the reference target engine revolution speed NR0 using the first engine-revolution-speed modification value and the second engine-revolution-speed modification value, to thereby obtain the target revolution speed NR01.

Moreover, the reference-revolution-speed decrease modification calculating portion 700*a*, the reference-revolution-speed increase modification calculating portion 700*b*, the operation-pilot-pressure-dependent engine revolution speed modification calculating portion 700*g*, and the pump-delivery-pressure signal modifying portion 700*k* constitute modification value modifying means for calculating reference widths of revolution speed modification (the reference-revolution-speed decrease modification DNL and the reference-revolution-speed increase modification DNP) for the first and second engine-revolution-speed modification values which are reduced as the reference target revolution speed decreases, and then modifying the first and second engine revolution-speed-modification values in accordance with the reference widths.

This embodiment constructed as described above can provide advantages below.

(1) In the arm-crowding and track operations, the engine-revolution-speed modification gain calculating portion 700*g* calculates the engine-revolution-speed decrease modification DND depending on the operation pilot pressure, while the calculating portions 700*q*, 700*r* and the maximum value selecting portion 700*s* cooperatively calculate the engine-revolution-speed increase modification DNH depending on the pump delivery pressure resulted from modifying the engine-revolution-speed modification gain KNP depending on the pump delivery pressure based on the modification gain KACH or KTRH depending on the operation pilot pressure. The reference target engine revolution speed NR0 is then modified using the engine-revolution-speed decrease modification DND and the engine-revolution-speed increase modification DNH, whereby the engine revolution speed is controlled under modification. Therefore, the engine revolution speed is increased with not only an increase of the input amount from the control lever or pedal, but also a rise of the pump delivery pressure. It is hence possible to achieve powerful excavation work with the arm-crowding operation, and high-speed or powerful traveling with the track operation.

On the other hand, in other operations than the arm-crowding and track operations, the modification gain KACH or KTRH is 0 and the reference target engine revolution speed NR0 is modified using only the engine-revolution-speed decrease modification DND depending on the operation pilot pressure, to thereby control the engine revolution speed. For example, during the boom-raising operation where the pump delivery pressure is greatly changed depending on the posture of the front operating mechanism, therefore, the engine revolution speed is not changed despite variations of the pump delivery pressure, and satisfactory operability can be achieved. Additionally, when the input amount from the control lever or pedal is small, the engine revolution speed is reduced and a great energy saving effect is resulted.

(2) When the operator sets the reference target engine revolution speed NR0 to be low, the reference-revolution-speed decrease modification calculating portion 700*a* and the reference-revolution-speed increase modification calculating portion 700*b* calculate respectively the reference-revolution-speed decrease modification DNL and the reference-revolution-speed increase modification DNP as small values, and the modifications DND, DNH for the reference target engine revolution speed NR0 become also small. In such works as leveling and lifting where the operator carries out the operation using a low range of the engine revolution speed, therefore, the modification width of the target engine revolution speed is reduced automatically, enabling the operator to perform fine works more easily.

(3) The modification gain calculating portions 700*d*1–700*d*4 each preset, as a modification gain, change of the engine revolution speed with respect to change of the input from the control lever or pedal (i.e., change of the operation pilot pressure) associated with the actuator to be operated correspondingly. Satisfactory operability is therefore achieved depending on the characteristics of the individual actuators.

In the calculating portion 700*d*1 for the boom-raising operation, for example, since the slope of the modification gain KBU is set to be small in the fine operating range, change of the engine-revolution-speed decrease modification DND is reduced in the fine operating range. Accordingly, the operator can more easily perform works which are to be effected in the fine operating range of the boom-raising operation, such as position alignment in lifting and leveling works.

In the calculating portion 700*d*2 for the arm-crowding operation, since the slope of the modification gain KAC is set to be small near the full lever stroke, change of the engine-revolution-speed decrease modification DND is reduced near the full lever stroke. Accordingly, excavation work can be performed by the arm-crowding operation with reduced variations of the engine revolution speed near the full lever stroke.

In the calculating portion 700*d*3 for the swing operation, since the slope of the modification gain is set to be small in the intermediate range of the engine revolution speed, the swing operation can be performed with reduced variations of the engine revolution speed in the intermediate range.

In the calculating portion 700*d*4 for the track operation, since the modification gain KTR is set to be small in a wide range including the fine operating range, the engine revolution speed can be increased from the fine track operation, and hence powerful traveling is achieved.

Further, the engine revolution speed at the full lever stroke is also variable for each of the actuators. In the calculating portions 700*d*1, 700*d*2 for the boom-raising and arm-crowding operations, for example, since the modification gains KBU, KAC are set to 0 at the full lever stroke, the engine revolution speed becomes relatively high and the delivery rates of the hydraulic pumps 1, 2 are increased. It is thus possible to lift a heavy load by the boom-raising operation and to perform powerful excavation work by the arm-crowding operation. Also, in the calculating portion 700*d*4 for the swing operation, since the modification gain KTR is set to 0 at the full lever stroke, the engine revolution speed becomes relatively high likewise and the traveling speed of the excavator can be increased. In other operations, since the modification gain is set to a value larger than 0 at the full lever stroke, the engine revolution speed becomes relatively low and the energy saving effect can be achieved.

(4) In other operations than mentioned above, the engine revolution speed is modified using, as representative values, the modification gains PL1, PL2 calculated by the calculating portions 700*d*5, 700*d*6. The configuration of the processing unit can be therefore simplified.

(5) When the engine revolution speed is controlled as described above, the engine revolution speed is varied upon change of the operation pilot pressure or the pump delivery pressure. In the pump maximum absorbing torque calculating portion 70*e* shown in FIG. 6, the pump maximum absorbing torque TR is calculated as a function of the modified target engine revolution speed NR1, thereby controlling the maximum absorbing torque of the hydraulic pumps 1, 2. Consequently, the engine output can be effectively utilized despite variations of the engine revolution speed.

According to the present invention, as described above, control of the engine revolution speed in accordance with the actuator load is performed only upon the operation of the first particular actuator depending on the direction and amount in and by which the first particular actuator is operated. In the operation where the engine revolution speed is desired to become higher as the actuator load increases, such as the arm-crowding or track operation of a hydraulic excavator, therefore, the engine revolution speed can be controlled in accordance with change of the actuator load as well. In other operations, such as the boom-raising operation, the engine revolution speed can be controlled just depending on the direction and input amount in and by which the corresponding operation instructing means is operated. As a result, the energy saving effect and satisfactory operability can be achieved.

Further, according to the present invention, when the target revolution speed entered by the operator is low, the modification width of the target engine revolution speed for changes of the actuator load and the input amount from the operation instructing means is reduced, whereby satisfactory fine operability can be achieved.

What is claimed is:

1. An auto-acceleration system for a prime mover of a hydraulic construction machine comprising a prime mover, at least one variable displacement hydraulic pump driven by said prime mover, a plurality of hydraulic actuators driven by a hydraulic fluid delivered from said hydraulic pump, operation instructing means for instructing operations of said plurality of hydraulic actuators, first detecting means for detecting command signals from said operation instructing means, second detecting means for detecting loads of said plurality of hydraulic actuators, and input means for instructing a reference target revolution speed of said prime mover, the reference target revolution speed being modified based on values detected by said first and second detecting means to provide a target revolution speed, thereby controlling a revolution speed of said prime mover, wherein said auto-acceleration system comprises:

first calculating means for calculating, based on the values detected by said first detecting means, a first engine-revolution-speed modification value depending on the direction and amount in and by which said plurality of hydraulic actuators are each operated, second calculating means for modifying, based on the values detected by said first detecting means, the loads detected by said second detecting means depending on the direction and amount in and by which at least one first particular actuator among said plurality of hydraulic actuators is operated, thereby calculating a second engine-revolution-speed modification value, and revolution speed modifying means for modifying the reference target revolution speed using the first engine-revolution-speed modification value and the second engine-revolution-speed modification value, thereby obtaining the target revolution speed.

2. An auto-acceleration system for a prime mover of a hydraulic construction machine according to claim 1, further comprising modification value modifying means for calculating reference widths of revolution speed modification for the first and second engine-revolution-speed modification values which are reduced as the reference target revolution speed decreases, and then modifying the first and second engine-revolution-speed modification values in accordance with the reference widths.

3. An auto-acceleration system for a prime mover of a hydraulic construction machine according to claim 1, further comprising third detecting means for detecting a maximum value of the command signals from said operation instructing means, wherein said first calculating means calculates, based on the values detected by said first detecting means, a first engine-revolution-speed modification reference value depending on the direction and amount in and by which a second particular actuator among said plurality of hydraulic actuators is operated, and calculates, based on the value detected by said third detecting means, a second engine-revolution-speed modification reference value depending on the direction and amount in and by which said plurality of hydraulic actuators are each operated, thereby calculating the first engine-revolution-speed modification value from the first engine-revolution-speed modification reference value and the second engine-revolution-speed modification reference value.

4. A control system for a prime mover and a hydraulic pump, comprising the auto-acceleration system according to claim 1, and pump control means for controlling a tilting position and a maximum absorbing torque of said hydraulic pump, wherein said pump control means determines a target maximum absorbing torque of said hydraulic pump as a function of the target revolution speed modified by said revolution speed modifying means, thereby controlling the maximum absorbing torque of said hydraulic pump.

5. An auto-acceleration system for a prime mover of a hydraulic construction machine according to claim 2, wherein said modification value modifying means modifies said first and second engine-revolution-speed modification values by multiplying the modification values by said reference widths.

* * * * *